United States Patent [19]

Suzuki et al.

[11] 4,455,819

[45] Jun. 26, 1984

[54] METHOD AND APPARATUS FOR FASCIATED YARN SPINNING

[75] Inventors: Yoshihisa Suzuki, Chiryu; Kazuo Seiki, Kariya, both of Japan

[73] Assignee: Kabushiki Kaisha Toyoda Jidoshokki Seisakusho, Aichi, Japan

[21] Appl. No.: 448,057

[22] Filed: Dec. 9, 1982

[30] Foreign Application Priority Data

Dec. 21, 1981 [JP] Japan ..... 56-206772

[51] Int. Cl.[3] ..... D01H 1/12; D01H 5/28

[52] U.S. Cl. ..... 57/404; 57/328; 57/411; 57/414; 57/415

[58] Field of Search ..... 57/400, 403, 404, 408, 57/411, 414, 415, 417, 328

[56] References Cited

U.S. PATENT DOCUMENTS 3,901,012 8/1975 Safar ..... 57/404 X 4,044,537 8/1977 Negishi et al. ..... 57/414 X 4,168,601 9/1979 Didek et al. ..... 57/411 X 4,322,942 4/1982 Fast et al. ..... 57/411

*Primary Examiner*—John Petrakes

*Attorney, Agent, or Firm*—Burgess, Ryan & Wayne

[57] ABSTRACT

A method and apparatus for spinning a modified fasciated yarn at a high production rate featuring a combination of open-end spinning and fasciated yarn spinning. A sliver is opened by a combing roller and deposited as a fiber layer on a fiber collecting surface of a drum rotor rotating at a high speed. Thereafter, the fiber layer is drawn off from the fiber collecting surface as a continuous fiber bundle by a central rotor rotating coaxially with the drum rotor at a faster speed. During the drawing-off operation, the fiber bundle is flattened to a ribbon form by making contact to a deflector and is subjected to a vortex within an air twisting nozzle mounted on the central rotor to form a resultant yarn. According to the present invention, high production rate can be obtained because a roller drafting system having aprons can be omitted.

11 Claims, 5 Drawing Figures

METHOD AND APPARATUS FOR FASCIATED YARN SPINNING

BACKGROUND OF THE INVENTION

1. Field of the Invention

This invention relates to a method and an apparatus for producing a fasciated yarn with a specific structure, a core portion of which has a true twist of the same direction as that of surface fibers entangling around the core portion, and for producing a two-folded yarn consisting of the above-mentioned yarns in one process.

2. Description of the Prior Art

Fasciated yarn spinning is a process in which a ribbon-like fiber bundle is continuously introduced into an air twisting nozzle and false-twisted by a vortex generated within a yarn passage in the air twisting nozzle, thereby causing edge portion fibers of the fiber bundle to entangle with a core portion thereof to form a yarn having a mechanical strength sufficient for practical use, though the core portion is of a substantially twistless structure.

The mechanism for forming the fasciated yarn is as follows. The ribbon-like fiber bundle has a plurality of "free end fibers" in its edge portion. "Free end fiber" means a fiber with one end embedded in the core portion of the fiber bundle and the other end from constraint from any other fibers. When the fiber bundle is subjected to the vortex, both the core portion and the free end fibers are rotated. The free ends remain straight in the early period of the twisting operation, therefore are finally wound onto the core portion with less number of twists than that of the core portion itself. During the untwisting operation after the twisting operation, the core portion of the fiber bundle is completely untwisted to its original state, i.e., zero twist. However, the free end fibers are overly untwisted past the zero twist point to an extent corresponding to the difference between the twist numbers of the core portion and the free end fibers at the end of the prior twisting operation and entangle around the twistless core portion to form a fasciated yarn.

Such fasciated yarn can be produced at a high rate by utilization of an air twising nozzle generating a high rotational speed vortex.

However, a conventional roller drafting system utilized for preparing the fiber bundle cannot endure a speed of processing as high as that of the above-mentioned fasciated yarn spinning, because the aprons in the drafting system would be easily damaged in a short time period.

In an entirely different area, there has been prevailed open-end spinning. In open-end spinning. In open-end spinning, a fiber opened from a sliver is fed onto a collecting surface of a rotating drum rotor to form fiber layers by the action of centrifugal force exerting on the open fibers. The fiber layers are then continuously drawn off from the collecting surface as a fiber bundle while being imparted with a true twist due to the rotation of the drum rotor during the drawing-off operation.

In open-end spinning, since the roller drafting system can be omitted, the afore-said problem is diminished. Moreover, this spinning system had also an advantages of high rate production due to light weight of the drum rotor. However, open-end spinning is not suitable for producing a thinner yarn because the yarn may break by excessive tension caused by the centrifugal force.

SUMMARY OF THE INVENTION

Accordingly, it is an object of the present invention to provide a method and an apparatus for fasciated yarn spinning with a high production rate.

It is another object of the present invention to provide a method and an apparatus for fasciated yarn spinning utilizing a drum rotor for collecting individually opened fibers to form a fiber bundle and at least an air twisting nozzle for false-twisting the fiber bundle with a vortex to form a fasciated yarn.

It is a further object of the present invention to provide a method and an appratus for producing a fasciated yarn having a true-twisted structure throughout its length. It is a still further object of the present invention to provide a method and an apparatus for producing in one process a folded yarn composed of two fasciated yarns.

BRIEF DESCRIPTION OF THE DRAWINGS

The invention will be described in detail with reference to the accompanying drawings, in which.

DESCRIPTION OF THE PREFERRED EMBODIMENTS

Figure 1:
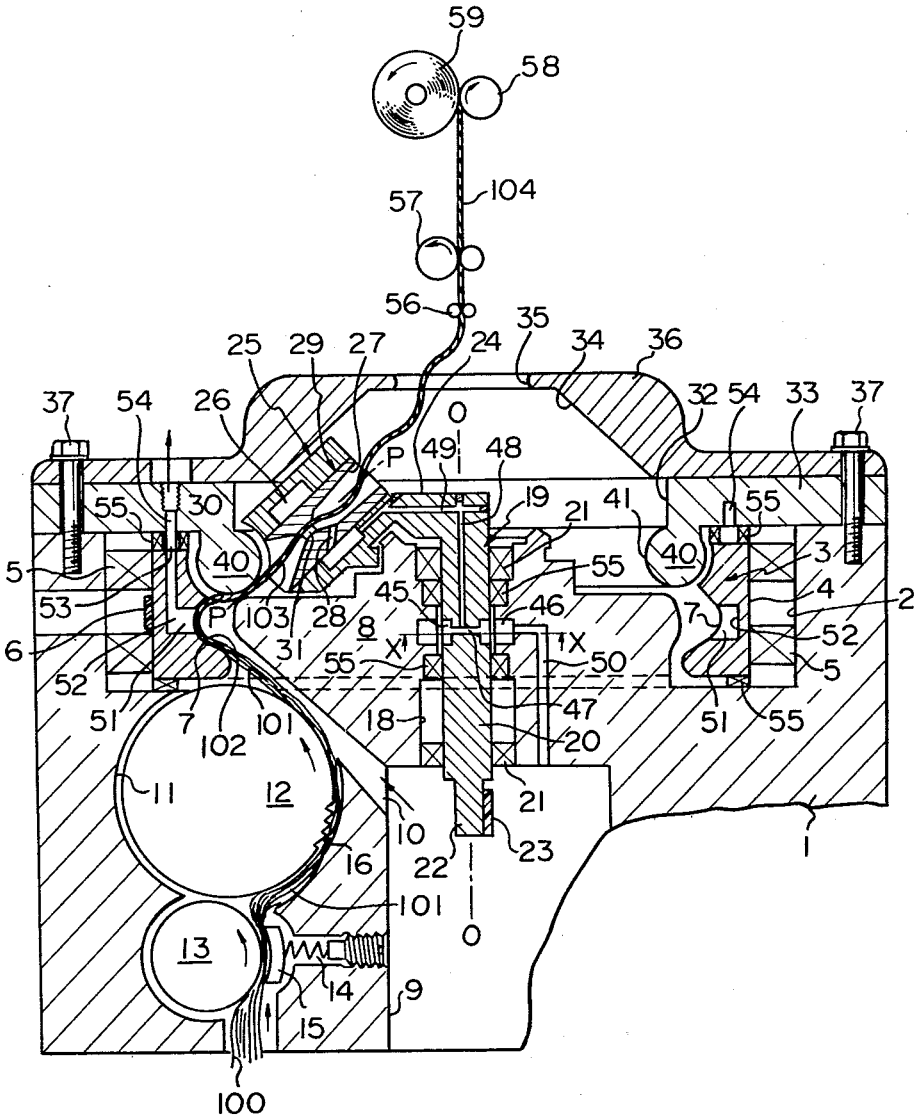
FIG. 1 is a sectional view of an embodiment of a spinning apparatus according to the invention.

In FIG. 1, at a top of a housing 1 is formed a stationary supporting wall 2 in a cylindrical shape with a center axis O—O. A drum rotor 3 is rotatably supported coaxially to the center axis O—O inside of the supporting wall 2 by means of bearings 5 and 5, mounted on a circumference 4 of the drum rotor 3, and is driven by a drive shaft (not shown) through a belt 6 engaged with the circumference 4.

On an inner wall of the drum rotor 3 is provided a recessed fiber collecting surface 7 of an annular shape, the cross-section of which is semi-circular and the rotational axis of which corresponds to the center axis O—O of the supporting wall 2.

Within the space inside the housing 1 and surrounded by the supporting wall 2 is provided a support member 8, a part of which confronts the fiber collecting surface 7 of the drum rotor 3 at a certain distance therefrom. An open cut 9 is formed beneath the support member 8 and a fiber channel 10 is provided from a wall of the open cut 9 to the fiber collecting surface 7. The fiber channel 10 may be open to the atmosphere or may be connected to a high-pressure air source, such as a fan, if necessary A combing roller 12 is rotatably mounted in a recess 11 and is forcibly driven in the direction shown by the arrow. A sliver 100 is fed to the combing roller 11 by means of a feed roller 13, also mounted in the recess 11, and a presser 15, urged onto the feed roller 13 by a spring 14, and is opened with saw teeth 16 projected on a periphery of the combing roller 12 into individual fibers 101. The opened fibers 101 are transferred to the fiber collecting surface 7 of the drum rotor 3 through the fiber channel 10 along with an air stream.

A step-wise hole 18 is formed coaxially with the axis O—O at a center portion of the support member 8 of the housing 1. A center shaft 20 of a central rotor 19 is inserted into the hole 18 and rotatably supported with bearings 21 and 21. The lower end of the center shaft 20 protrudes into the open cut 9 to form a pulley 22. The central rotor 19 is rotated by a drive shaft (not shown) through a belt 23 engaged with the pulley 22 in the same directions as the drum rotor 3 at a higher rotational speed N+n relative to the rotational speed N of the drum rotor 3.

An arm 24 extends radially from an upper end of the center shaft 20. At the outer end of the arm 24 is mounted a hollow cylindrical guiding member 25, on an inner wall of which is provided a recessed air chamber 26 of an annular shape. Inside of the guiding member 25 is tightly inserted an air twisting nozzle 29 having a yarn passage 27 and a plurality of jets 28, whereby the air chamber 26 can communicate with the jets 28. The yarn passage 27 directs onto the fiber collecting surface 7 and inclines relative to the axis O—O so that an axis P—P thereof becomes further from the axis O—O as the yarn passage 27 goes downward.

The jets 28 are circumferentially equidistantly bored in a wall of the nozzle 29 and open on an inner wall of the yarn passage 28 with such an inclination that an image of the jets 28 projected onto a plane including the axis P—P of the yarn passage 27 intersects the axis P—P with a certain acute angle, for example 45°, and that the jets 28 deviate from the axis P—P with a certain distance, whereby a vortex occurs within the yarn passage 27 along and around the axis P—P.

An inlet opening 30 of the nozzle 29 is of a conical shape and connected to the yarn passage 27 through an orifice 31 having a smaller diameter than that of the yarn passage 27. Accordingly, a suction stream can be formed from the inlet opening 30 to the yarn passage 27 when high pressure air in the air chamber 26 is ejected from the jets 28 into the yarn passage 27.

On the top housing 1, a plate 33 having a central opening 32 to permit rotation of the guiding means 19 is mounted. A lid 36 having an interior space 34 to permit rotation of the guiding means 19 and an outlet opening 35 at a top wall thereof is mounted onto the plate 33. Both the plate 33 and the lid 36 are rigidly secured to the housing 1 with bolts 37 and 37. A deflector 40 protrudes annularly on an inner wall of the opening 32 of the plate 33 about the axis O—O. A cross-section of the deflector 40 along a plane including the axis O—O is substantially of a circular shape encircled with an arcuate surface 41, except for a root portion connected to the plate 33. The deflector 40 is disposed between an imaginary plane of rotational traces of the inlet opening 30 and the inner wall of the drum rotor 3 with suitable clearance, in other words, in a close, but non-contact relationship. Further, the portion of the arcuate surface 41 furthest from the root position is in the vicinity of the axis P—P of the yarn passage 27, preferably tangential to the axis P—P or intersecting thereto. Particularly, in FIG. 2, there is shown the deflector 40 having the arcuate surface 41 tangential to the axis P—P.

Figure 3:
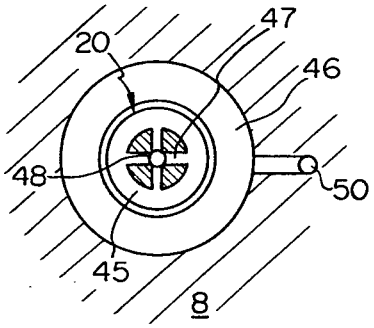
FIG. 3 is a sectional view along a plane X—X of FIG. 1, illustrating a structure of ducts for air supply.

An annular groove 45 is provided on a circumference of the center shaft 20 about the axis O—O and on the inner wall of the stepwise hole 18 in which the center shaft 20 is supported. An annular air reserver 46 is provided surrounding the groove 45. The groove 45 and the air chamber 26 communicate to each other through ducts 47 and 48 respectively bored in the center shaft 20 radially and axially and another duct 49 in the arm 24 (refer to FIG. 3). On the other hand, the air reserver 46 is connected to a high-pressure air source (not shown) through a duct 50.

Through the above-mentioned duct system, high-pressure air is fed from the air source to the air chamber 26 and is ejected from the jets 28 to cause a vortex within the yarn passage 27. A plurality of suction holes 51 are opened on the fiber collecting surface 7 of the drum rotor 3. The suction holes 51 communicate through an annular channel 52 to a suction duct 53 opening on the upper surface of the drum rotor 3. The duct 53 is connected to a subatmospheric air source (not shown) through an annular channel 54 formed on the lower surface of the plate 33 at a position corresponding to the duct 53. Therefore, the collecting surface 7 of the drum rotor 3 can be subjected to a negative pressure. Reference numerals 55 designate air sealing means for preventing air leakage.

Additionally, as shown in FIG. 1, a yarn guide 56, a draw-off roller 57, and a winding drum 58 are arranged for taking up the resultant yarn as usually utilized in the conventional apparatus.

The operation of the above-mentioned apparatus according to the present invention will now be explained.

A sliver 100 is supplied by the feed roller 13 and the presser 15 to the combing roller 12, then is opened to individual fibers 101 by means of the saw teeth 16 of the combing roller 12, which rotates in the arrow direction. The fibers 101 are transported to the fiber collecting surface 7 of the drum rotor 3, which is rotating at a high speed, through the fiber channel 10 along with an air stream supplied thereto.

Since the fiber collecting surface 7 is concaved in an arcuate shape cross-section, the air stream turns in its travelling direction along the curvature of the collecting surface 7 to deposit the fibers 101 evenly on the fiber collecting surface 7 to form a fiber layer 102. The fiber layer 102 is held thereon by centrifugal force as well as the sucking effect from the suction holes 51.

After the fiber layer 102 is formed on the fiber collecting surface 7, a pilot yarn is inserted into the drum rotor 3 through the yarn passage 27 and is engaged with the fiber layer 102. The engaged end of the pilot yarn is entangled with the fiber layer 102 and peels the fiber layer 102 from the fiber collecting surface 7 continuously to form a fiber bundle 103. The fiber bundle 103 is drawn out from the drum rotor 3 by the draw-off roller 57 through the yarn passage 27 and is wound onto the package 59. Thus the spinning operation is carried out continuously.

During the above-mentioned drawing-off operation, the fiber bundle 103 is false-twisted within the yarn passage 27 to form a fasciated yarn, while, at the same time, being true-twisted between the deflectors 40 and the draw-off roller 57 due to rotation of the central rotor 19 including the air twisting nozzle 29.

Figure 2:
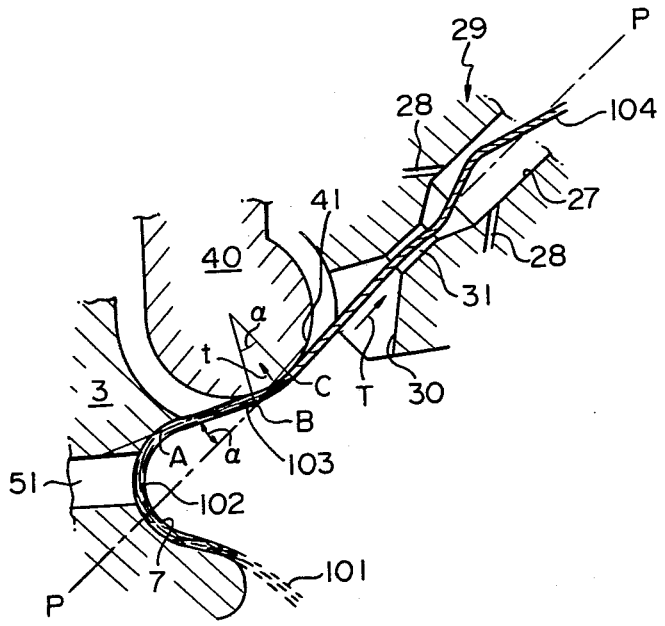
FIG. 2 is an enlarged sectional view of a main part of a yarn passage in the apparatus shown in FIG. 1.

As shown in FIG. 2, the fiber bundle 103 introduced into the inlet opening 30 and the orifice 31 of the air twisting nozzle 29 is subjected to a suction stream caused by an air stream ejected from the jets 28 and, thereby, is subjected to a dragging force T directed toward the yarn passage 27. The fiber bundle 103 is pressed onto the arcuate surface 41 of the deflector 40 with a resultant force t expressed by the following equation:

$t = T \cdot (\sin\alpha/2)$, where $\alpha$ is an angle between the axis P—P which corresponds to the direction of the force T and a line connecting points A and B where the fiber layer 102 is peeled from the fiber collecting surface 7 where the fiber bundle 102 contacts the arcuate surface 41, respectively. Due to the force t, the fiber bundle 103 is flattened and widened to a maximum width in the traveling passage from the aforesaid point A to a point C where the fiber bundle 103 is peeled from the arcuate surface 41.

Figure 4:
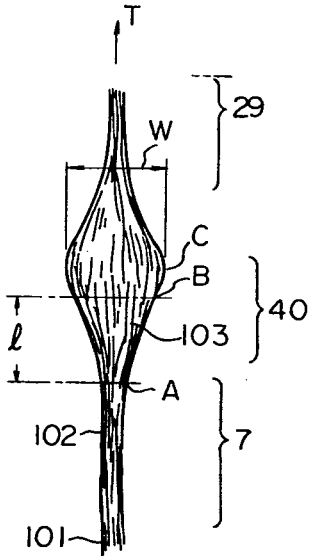
FIG. 4 is a top view of a fiber bundle formed within the yarn passage shown in FIG. 2.

FIG. 4 illustrates transformations of the fibers 101 to the fiber layer 102 and the ribbon-like fiber bundle 103, each of which corresponds to a stage of the air duct 10, the fiber collecting surface 7, or the deflector 40, respectively. This flattening of the fiber bundle is very useful for producing a well-fasciated yarn.

The air stream ejected from the jets 28 into the yarn passage 27 causes a vortex able to impart the same directional twist to the fiber bundle 103 as the true twist given by rotation of the drum rotor 3. The rotational direction of the vortex is not, however, limited to the above one, but may be reversed under certain spinning conditions such as the rotational speed of the drum rotor, pressure of the ejected air, and drawing-off speed of the yarn.

The fiber bundle 103 which has been widened by contact with the deflector 40 is guided into the yarn passage 27 and twisted by the vortex in the upstream region. The twist imparted to the fiber bundle becomes larger at the core portion of the fiber bundle and smaller at the edge portion thereof, as described hereinbefore. The twist given to the fiber bundle in the upstream region is untwisted in the downstream region due to the "false-twisting" effect. Finally, the edge portion fibers entangle around the twistless core portion with a twist of a direction reverse to the false-twist and of a number corresponding to the twist difference of the core portion and the edge portion in the false-twisting zone. At the same time, the aforesaid portion of fiber bundle 103 is true-twisted due to the rotation of the drum rotor 3. Accordingly, the resultant yarn has a structure in which a conventional fasciated yarn with a twistless core portion is additionally twisted in the direction so as to strengthen the fasciated effect.

As the rotational speed N of the drum rotor 3 increases, the evenness of the fiber layer 102 deposited on the fiber collecting surface improves because of the doubling effect. However, a high rotational speed of the drum rotor 3 results in a high centrifugal force which requires a large tension for drawing off the resultant yarn from the fiber collecting surface and may cause yarn breakage in the case of spinning of thinner yarns. Therefore, the rotational speed N should be selected in consideration of a balance of the above-mentioned facts.

According to the experience of the present inventors, the minimum rotational speed of a drum rotor 3 with a 100 mm inner diameter is approximately 1000 rpm. On the other hand, the central rotor 19 should rotate at a speed where the fiber layer 102 peels off from the fiber collecting surface 7 by an amount corresponding to the yarn drawing-off speed. In the above case, if the yarn drawing-off speed is 200 m/min, the rotational speed of the central rotor 19 is preferably $1000+636=1636$ rpm.

One set of preferable spinning conditions is as follows:

Rotational speed of drum rotor: 5000 rpm

Rotational speed of central rotor: 6000 rpm

Yarn drawing-off speed 314 m/min

Further, a distance l between the peeling point A of the fiber bundle 103 from the drum rotor 3 and the contact point B of the fiber bundle 103 to the deflector 7 should be selected equal to a mean length of staple fibers composing the sliver 100 for securing stable spinning.

Figure 5:
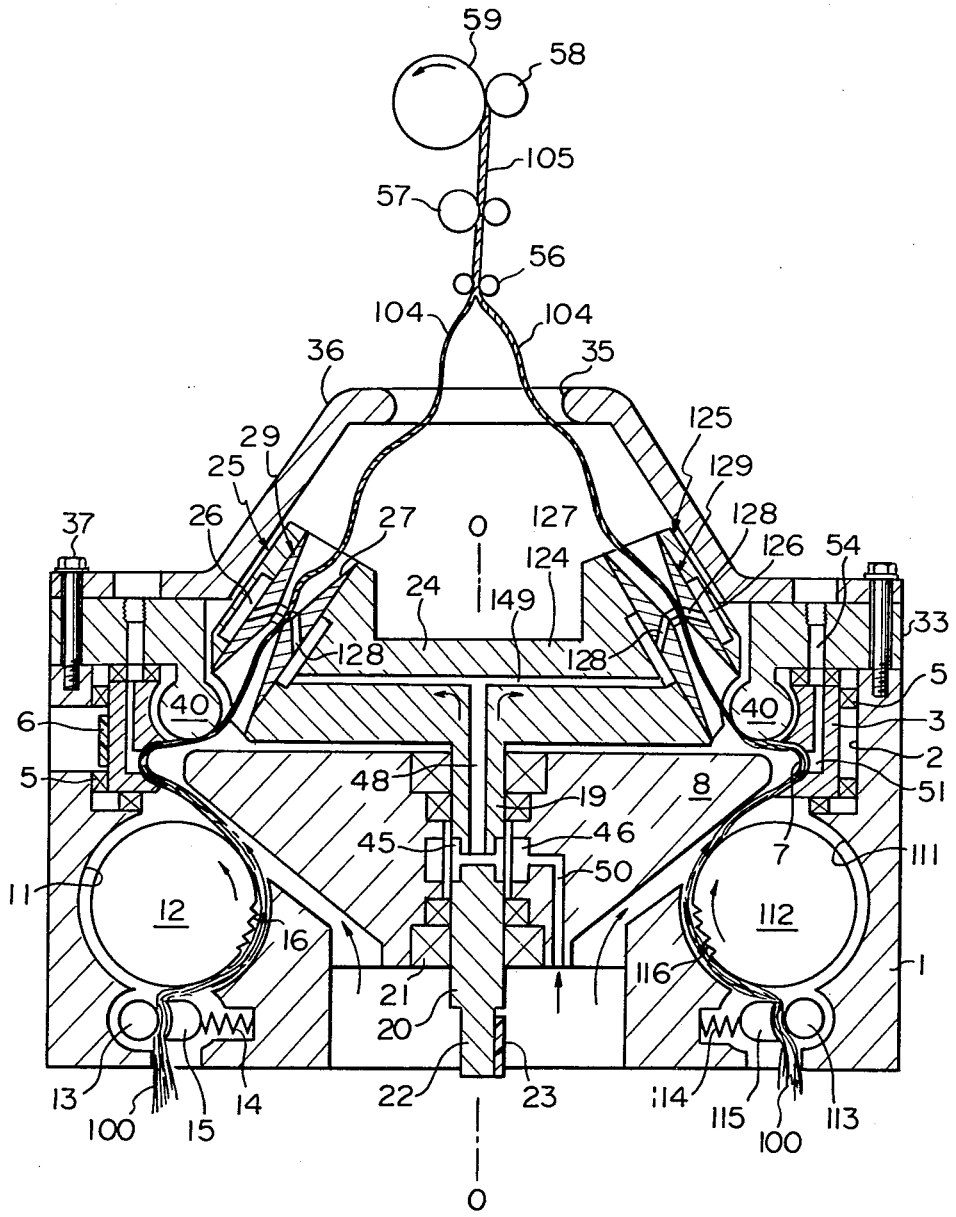
FIG. 5 is a sectional view of another embodiment of the spinning apparatus according to the invention.

A second embodiment according to the present invention is illustrated in FIG. 5. The same reference numerals are utilized for designating parts of the second embodiment the same as those of the first embodiments shown in FIG. 1. An explanation of those parts is omitted.

In the second embodiment, another arm 124 extends radially from the upper end of the center shaft 20 toward the opposite direction of the arm 24 relative to the axis O—O. At the outer end of the arm 124 is mounted a hollow cylindrical guiding member 125. On the other wall of the guiding member 125 is provided an annular recess to form an air chamber 126. An air twisting nozzle 129 having a yarn passage 127 and jets 128 is rigidly inserted into the guiding member 125, so that the air chamber 126 communicates with the jets 128. Air from the high-pressure air source (not shown) is ejected from the jets 128 into the yarn passage 127 to cause a vortex through a duct 149 bored in the arm 124 and connected to the duct 48 in the center shaft 20. The above-said air twisting nozzle 129 has the same size and inclination as the nozzle 29.

In the second embodiment, another recess 111 is provided symmetrically to the recess 11 about the axis O—O. A combing roller 112, a feed roller 113 and a presser 115 urged onto the feed roller 113 by means of a spring 114 are arranged therein. Individual fibers 101 opened and separated by saw teeth 116 provided on the periphery of the combing roller 112 are transported to separate sections of the fiber collecting surface 7 of the drum rotor 3 through a fiber channel 110.

According to the second embodiment, the fibers 101, 101' supplied from two combing rollers 12, 112 arranged symmetrically to each other about the axis O—O are received onto separate sections of the fiber collecting surface 7 of the drum rotor 3 and are withdrawn separately from the drum rotor 3 to form the fiber bundles 103, 103', respectively. The fiber bundles 103, 103' are fasciated by means of the air twisting nozzles 29 and 129, respectively, during the above withdrawing operation and are simultaneously imparted with a true twist throughout the length thereof by the rotation of the drum rotor 3 to form two resultant yarns 104, 104'.

Thereafter, the resultant yarns 104, 104' may be taken up by a yarn guide and winding drum to form two packages of the single yarn 104, 104' or may be plied together and taken up onto a package of a two-folded yarn 105 as shown in FIG. 5. In the former case, the productivity of the apparatus can be doubled compared to the one shown in FIG. 1. In the latter case, the two-folded yarn can be obtained in one process.

According to the present invention, since a fiber bundle is continuously formed from a fiber layer deposited on a fiber collecting surface of the drum rotor without utilizing a roller drafting system, high processing speed can be attained compared to a conventional fasciated spinning system while maintaining good evenness of the resultant yarn.

Since the fiber bundle is flattened immediately after being peeled off from the fiber collecting surface to form a fiber ribbon by means of a deflector with the air of centrifugal force and a dragging force of suction air, a plurality of free end fibers are formed in the edge portion, thereby a well-fasciated yarn can be obtained. Further, since an additional twist is imparted to an intermediate yarn drawn out from the air twisting nozzle due to rotation of the drum rotor, a resultant yarn with a good mechanical strength can be formed.

According to the second embodiment of the present invention, since two sets of combing rollers and air twisting nozzles are installed ln one apparatus, two single yarns are spun simultaneously from one drum rotor, or a folded yarn is obtained in one process.

We claim:

1. A method for fasciated yarn spinning, comprising:
(A) opening a sliver to individual fibers;
(B) depositing said individual fibers on a fiber collecting surface provided on the inner wall of a rotating drum rotor and holding said fibers as a fiber layer by centrifugal force;
(C) peeling said fiber layer from said fiber collecting surface to continuously form a fiber bundle by means of a guiding member rotating coaxially with said drum rotor at a faster rotational speed than that of said drum rotor and simultaneously imparting to said fiber bundle a twist proportional to the rotation of said guiding member while drawing off said fiber bundle from said drum rotor;
(D) widening said fiber bundle into a ribbon-like form by making said fiber bundle contact a deflector between said first collecting surface and said guiding member;
(E) imparting a false-twist to said fiber bundle by applying a vortex around a circumference of said widened fiber bundle, thereby forming a fasciated yarn.

2. A method according to claim 1, in which said vortex exerts a rotational force and a dragging force to said fiber bundle.

3. A method as claimed in claim 2 in which said fiber layer held on said fiber collecting surface is subjected to suction force caused by suction holes provided on said fiber collecting surface.

4. A method according to claim 1 in which said fiber layer held on said fiber collecting surface is subjected to suction force caused by suction holes provided on said fiber collecting surface.

5. A method for fasciated yarn spinning, comprising:
(A) opening two slivers to individual fibers,
(B) depositing said individual fibers from each sliver separately on a fiber collecting surface provided on the inner wall of a rotating drum rotor and holding said fibers as two fiber layers by centrifugal force,
(C) peeling each fiber layer from said fiber collecting surface to continuously form two fiber bundles by means of two guiding members rotating coaxially with said drum rotor at a faster rotational speed than that of said drum rotor and simultaneously imparting to each fiber bundle a twist proportional to the rotation of each said guiding member while drawing off said fiber bundles from said drum rotor;
(D) widening said fiber bundles into ribbon like forms by making said fiber bundles separately contact a deflector between said fiber collecting surface and each said guiding member;
(E) imparting a false-twist to each fiber bundle by applying a vortex around a circumference of each widened fiber bundle, thereby forming two fasciated yarns;
(F) plying the two fasciated yarns to form a folded yarn.

6. An apparatus for fasciated yarn spinning, comprising a housing including therein;
a fiber opening means for opening a supplied sliver into individual fibers;
a drum rotor supported rotatably about a rotational axis and provided with a fiber collecting surface on an inner wall thereof;
a driving means for rotating said drum rotor;
a fiber channel for transporting said individual fibers to said fiber collecting surface along with an air stream;
a central rotor comprising a center shaft supported rotatably about said rotational axis, an arm extending radially from an upper end of said center shaft, and a hollow cylindrical guiding member mounted at an outer end of said arm, an axis of said guiding member inclining so as to direct said fiber collecting surface;
a driving means for rotating said central rotor at higher rotational speed in the same direction relative to that of said drum rotor;
an air twisting nozzle provided with a yarn passage therethrough and at least a jet opening on an inner wall of said yarn passage for generating a vortex within said yarn passage, said air twisting nozzle being inserted rigidly into said guiding member;
a deflector bulged annularly about said rotational axis from an inner wall of said housing, said deflector being disposed so that opposite sides of a surface of said deflector face respectively said inner wall of said drum rotor and a rotational trace of an outer end of said guiding member with a predetermined clearance and that said axis of said guiding member passes in the vicinity of the outermost surface of said deflector.

7. An apparatus according to claim 6, in which said drum rotor is supported by means of bearings mounted between an outer wall of said drum rotor and said inner wall of said housing and in which said central rotor is supported by inserting said center shaft through bearings into a step-wise hole provided in a support member composing a part of said housing.

8. An apparatus according to claim 7 wherein a plurality of suction holes communicating to a subatmospheric air source are provided in said fiber collecting surface.

9. An apparatus according to claim 6, wherein a plurality of suction holes communicating to a subatmospheric air source are provided in said fiber collecting surface.

10. An apparatus for fasciated yarn spinning, comprising a housing including therein:
two fiber opening means, each for opening a supplied sliver into individual fibers;
a drum rotor supported rotatably about a rotational axis and provided with a fiber collecting surface on the inner wall thereof;
a driving means for rotating said drum rotor;
two fiber channels, each for transporting said individual fibers to sections of said fiber collecting surface along with an air stream;
a central rotor comprising a center shaft supported rotatably about said rotational axis, two arms extending radially and symmetrically from an upper end of said center shaft, and two hollow cylindrical guiding members mounted at each outer end of said arms, each axis of said guiding members inclining so as to direct said fiber collecting surface;

a driving means for rotating said central rotor at a higher rotational speed in the same direction relative to that of said drum rotor;

two air twisting nozzles, each provided with a yarn passage therethrough and at least a jet opening on an inner wall of said yarn passage for generating a vortex within said yarn passage, said air twisting nozzle being inserted rigidly into said guiding member; and a deflector bulged annularly about said rotational axis from an inner wall of said housing, said deflector being disposed so that opposite sides of a surface of said deflector face respectively said inner wall of said drum rotor and a rotational trace of an outer end of said guiding members with a predetermined clearance, and that said axis of said guiding members passes in the vicinity of the outermost surface of said deflector.

11. An apparatus according to claim 10, further comprising a take-up means for plying the two resultant yarns from said housing.

* * * * *